United States Patent [19]

Preus

[11] 4,073,143

[45] Feb. 14, 1978

[54] BARRIER FOR WATER CARRIED POLLUTANTS

[76] Inventor: Paul Preus, 21 Smith Road, Toms River, N.J. 08753

[21] Appl. No.: 820,239

[22] Filed: July 29, 1977

Related U.S. Application Data

[63] Continuation-in-part of Ser. No. 683,189, May 4, 1976, abandoned.

[51] Int. Cl.[2] ..... E02B 15/04; E02B 3/04

[52] U.S. Cl. ..... 61/1 F; 210/DIG. 25

[58] Field of Search ..... 61/1 F, 3-5; 210/DIG. 25, DIG. 26, 242

[56] References Cited

U.S. PATENT DOCUMENTS

| | | | |
|---|---|---|---|
| 3,499,290 | 3/1970 | Smith | 61/1 F |
| 3,922,862 | 12/1975 | Vidilles | 61/1 F |

FOREIGN PATENT DOCUMENTS

| | | | |
|---|---|---|---|
| 1,305,469 | 8/1962 | France | 61/1 F |
| 1,558,927 | 1/1969 | France | 61/1 F |

*Primary Examiner*—Dennis L. Taylor
*Attorney, Agent, or Firm*—Harold L. Stowell

[57] ABSTRACT

A barrier for water carried pollutants comprises a series of end to end connectable boom sections containing a flotable material; fluid impervious connectors for the ends of the boom sections; flexible draft members and associated connectors for maintaining the integrity of the boom if it becomes necessary to replace one or more of the boom sections, and means associated with the flexible draft members and the fluid impervious connectors whereby separating stresses are minimized at the end connections of the boom sections.

3 Claims, 7 Drawing Figures

16
18
10
14
34
38
36
20
22
40
26
30
28
12
32
24

42
50
44a
50
44
40
48
52
44
66
88
66
108
108
62
60
46
46
104

BARRIER FOR WATER CARRIED POLLUTANTS

CROSS-REFERENCE TO RELATED APPLICATIONS

This application is a continuation-in-part of my application Ser. No. 683,189 filed May 4, 1976, now abandoned.

Related subject material is disclosed in my U.S. Pat. No. 4,011,175 issued Mar. 8, 1977 which is a continuation of application Ser. No. 292,886 now U.S. Pat. No. 3,855,152 which is a division of application Ser. No. 83,640 filed Oct. 24, 1970, now abandoned.

Further related subject matter is disclosed in my U.S. Pat. Nos. 3,849,989; 3,667,235; 3,783,621 and 3,667,225.

BACKGROUND OF THE INVENTION

1. Field of the Invention

Floating barriers, known generally as oil booms, have been found to have great utility in containing and controlling oil slicks and other water carried pollutants on and in bodies of water. The barriers usually include flotation elements having a depending liquid impervious skirt which, when deployed around or in a controlling position relative to the pollutant, provide means to contain or prevent the pollutant from spreading or moving into uncontaminated areas.

SUMMARY OF THE INVENTION

This invention is directed to a barrier for containing and controlling water carried pollutants, for example, oil wherein the entire barrier is composed of a series of boom sections which are connectable in end to end relationship with each of the boom sections containing a flotation material; generally liquid impervious connectors for the ends of the boom sections; flexible draft members and associated separable connectors for maintaining the continuity of the boom, and means associated with the flexible draft members and the fluid impervious connectors between the boom section to reduce to a minimum separating stresses at the end to end connections of the boom sections.

The invention will be more fully described in light of the accompanying drawing wherein like components throughout the figures are indicated by like numerals and wherein:

Figure 1:
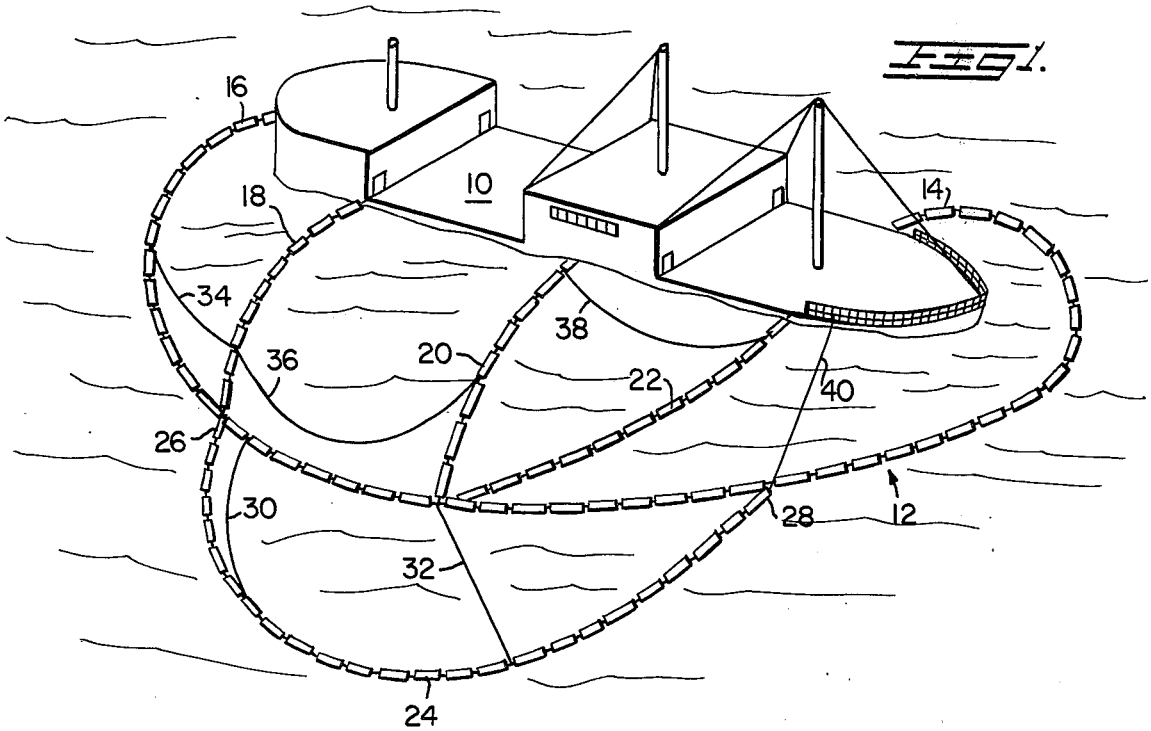
FIG. 1 is a somewhat diagrammatic perspective view of oil containing booms about a partially submerged vessel having oil leaking therefrom.

Referring particularly to FIG. 1, 10 generally designates a partially submerged vessel having oil leaking therefrom and 12 designates a primary containment boom having ends 14 and 16 secured to portions of the vessel 10. The zone within the bounds of containment boom 12 is divided by other boom sections 18, 20 and 22 each having one end secured to a portion of the partially submerged vessel and the other end connected to the primary containment boom 12 at selected boom section joints.

FIG. 1 also illustrates the use of an additional containment boom 24 having ends 26 and 28 connected to section joints of the main containment boom 12. The supplemental containment boom 24 is placed downstream of the partially submerged vessel 10 and is also maintained in its illustrated configuration by cables 30 and 32. The cables 30 and 32 each have one end connected to the supplemental boom 24 and the other ends connected to the main containment boom 12.

FIG. 1 also illustrates the use of additional cables 34, 36, 38 and 40 which maintain the illustrated positioning of the primary boom 12 and the segmenting booms 18, 20 and 22.

Each of the cables and each of the supplemental booms are, as hereinbefore set forth, connected at joints between the ends of boom sections, all as to be more fully described hereinafter.

Each of the booms 12, 18, 20, 22 and 24 are composed of a plurality or series of boom sections, two of which are shown at 40 and 42 in FIGS. 2, 3, 5 and 6. Each of the boom sections comprises a generally tubular element 44 and a depending skirt 46. The tubular sections 44 may be provided with an upstanding fin 48 provided with hand grips 50 at spaced intervals there along.

The handles or hand grips 50 are useful in deploying and retrieving the boom sections. Further, the handles 40 are also very useful in storing the boom sections as the handles may be merely slipped over pegs spaced at least a pair of handles distance or multiples thereof. The hand grips have also been found to be helpful in cleaning the boom sections prior to reuse as the handles may be hung over hooks movably positioned above a scrub tank.

The upstanding fin 48 is useful in reducing slopover of the hydrocarbons being contained within the boom by wind, currents and wave action.

Within the tubular portions 44 is maintained a suitable flotatable material 52. Suitable flotatable material may include, cork, foam plastics such as urethane foams and, inflatable bladders, tubes and the like.

Where desired, the cylindrical elements 44 may contain a selective oil absorbing and/or adsorbing material, and in such case, the tube 44 would be constructed of liquid pervious material such as mesh, which mesh may be formed of organic and/or inorganic fibers, plastic, metal or combinations thereof. Where each of the tubular portions of the boom is filled with a non-oil or hydrocarbon absorbent material such as foam plastic, cork or the like, then the material of construction of such tubular portions would be impervious, and a nylon reinforced, oil resistant fabric has been found to be very satisfactory.

A preferred oil absorbing flotation material may comprise "Sorbent C", an oleophilic-hydrophobic-lighter than water composition which will selectively absorb hydrocarbons floating on water. Such oleophilic-hydrophobic-lighter than water composition may comprise expanded pearlite 60–80% by weight; cellulose fibers 13–33% by weight; clays 4–8% by weight; and asphalt 1–5% by weight, all as more fully described in my U.S. Pat. Nos. 3,885,152 and 4,011,175.

Figure 3:
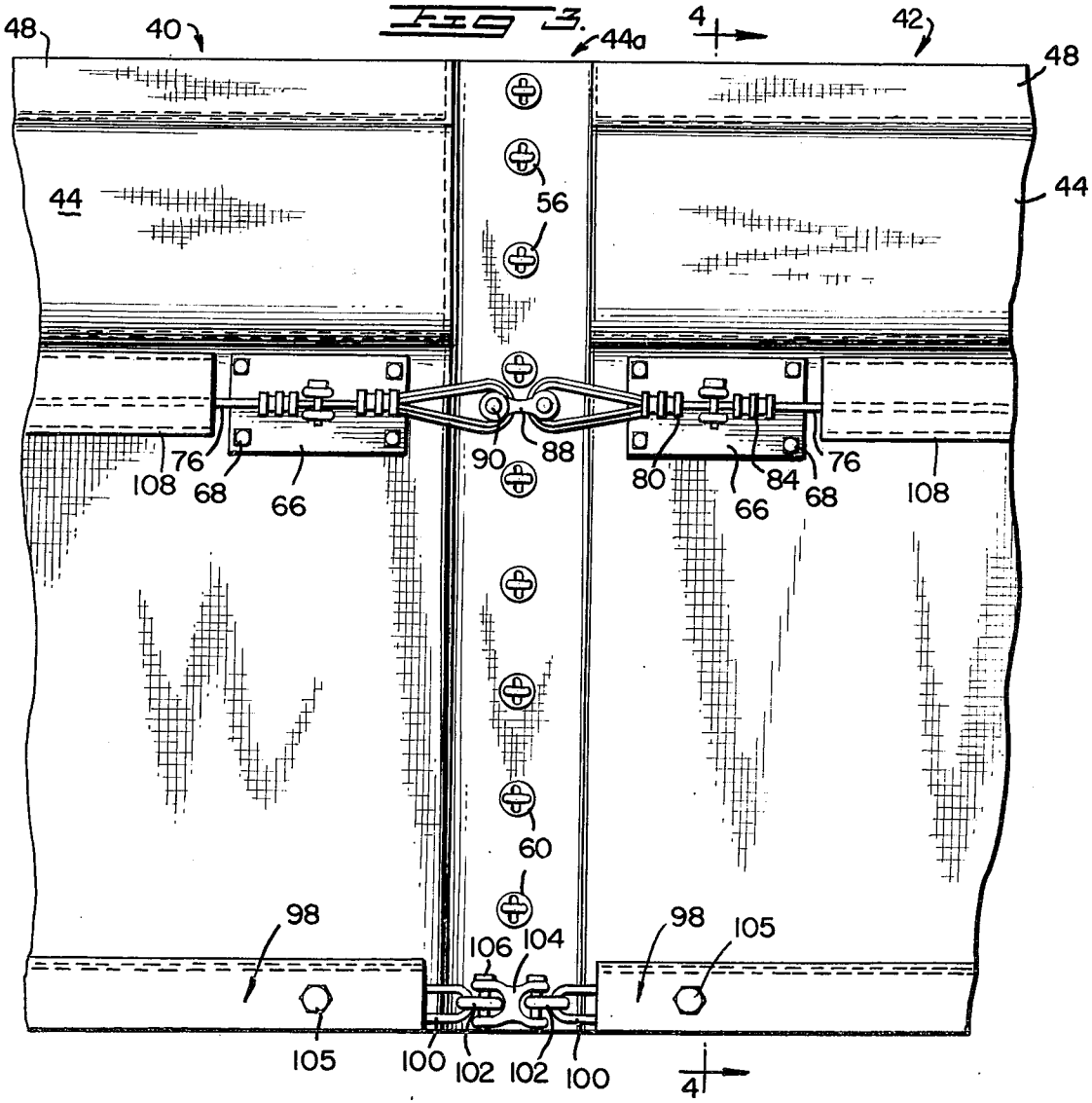
FIG. 3 is an enlarged fragmentary elevational view of the structures shown in FIG. 2.
Figure 5:
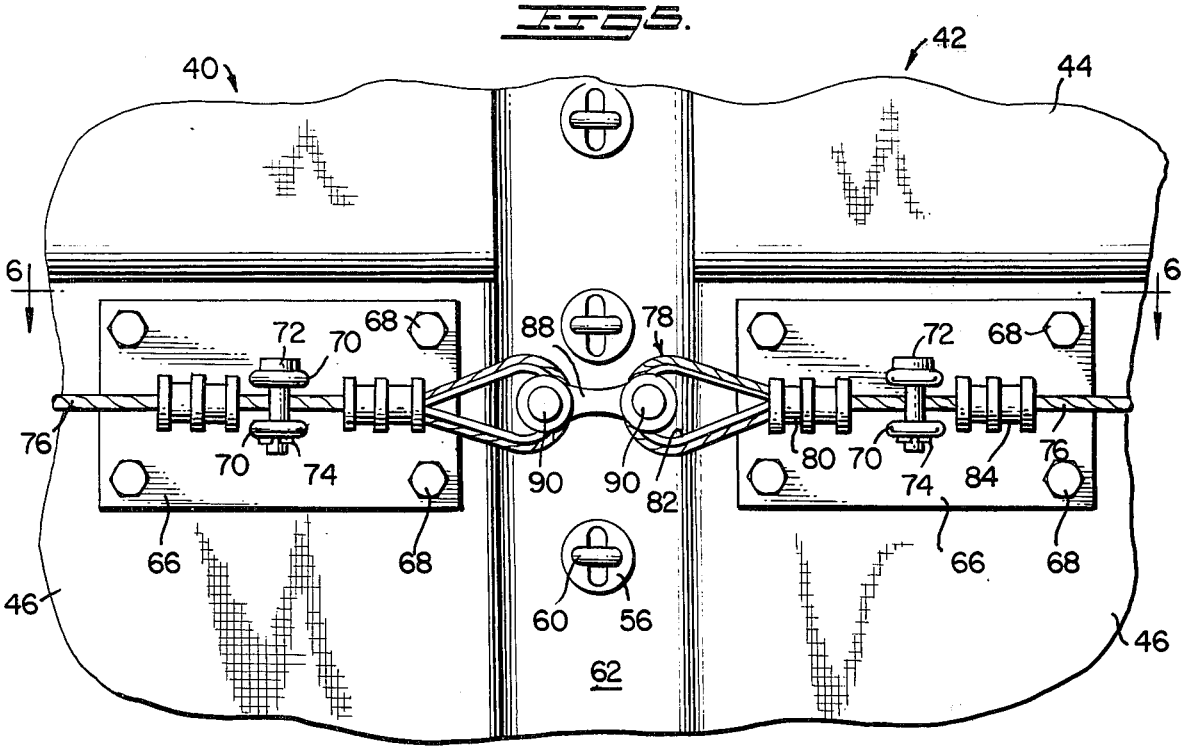
FIG. 5 is a further enlarged fragmentary view of the generally liquid impervious connection between a pair of boom sections in partially closed arrangement.
Figure 6:
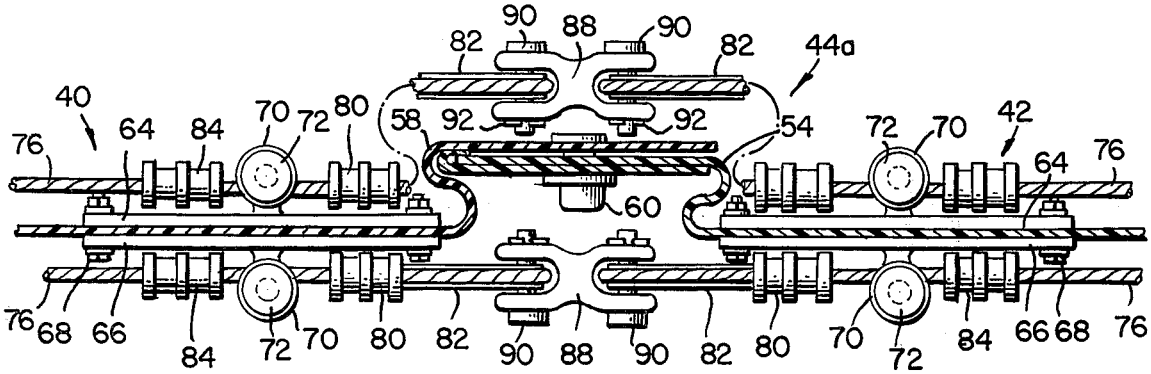
FIG. 6 is a section on line 6—6 of FIG. 5.

Referring now to FIGS. 3 through 7, one end of each boom section 42, designated **44*a* (FIG. 6), has an extended end portion 54 provided with a plurality of vertically aliened openings containing grommets. The opposite end of each boom section 40, generally designated 44*b* (FIG. 6), is provided with an extended flap portion 58, which extended flap portion receives a plurality of fasteners 60 of the sister hook type with the fasteners 60 aliened with the openings in extended flap 54 of end 44*a*. Further, each end 44*b* has stitched thereto a secondary flap 62 to provide a furcated closure adapted to receive extended flap 54 of the opposite end 44*a* of the adjacent boom section. The flap 54 is inserted between flaps 58 and 62 and the sister fasteners 60 are pressed through the grommet's in flaps 54 and 62, then turned, as illustrated in FIGS. 3 and 6** to provide an overlapping seal between boom sections.

Just below the zone of the tubular portion 44, each side of each end of each boom section 40, 42, etc. is provided with a metal stiffening plate 64 for one side and 66 for the other, which plates are bored to receive nut and bolt assemblies generally designated 68.

Figure 7:
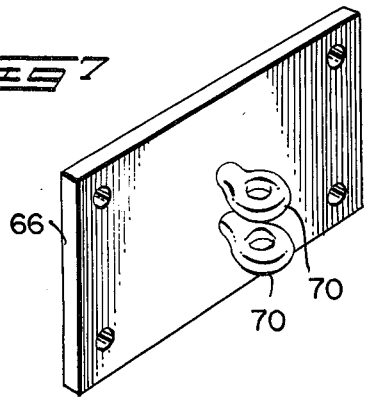
FIG. 7 is a perspective view illustrating one of the anchor plates of the invention.

Each plate 66 has welded thereto a pair of spaced eyes 70 as more clearly illustrated in FIG. 7.

The spaced eyes 70 receive a clevis or shackle pin 72 having one end with an enlarged head and the other bored to receive a carter key 74, all as more clearly illustrated in, for example, FIG. 5 of the drawing. The length of the shanks of the eyes 70 is such that, with the clevis pin 72 in place, there is room to receive between the outer face of each plate 66 and the inner surface of the shank of the clevis pin 72 a cable 76. In a preferred form of the present invention, where in the tubular portion 44 of the boom is about 6½ inches in diameter and the skirt 46 is about 2 feet long, plates 66 having a long dimension of 4 inches and a small dimension of 2½ inches with about ½ inch spacing between each of the eyes 70, has been found to be satisfactory. With such a construction, a metal cable ¼ inch in diameter has also proved to be satisfactory.

Each of the cables 76 is bent upon itself as at 78 to form a loop, which loop is maintained by a pressed fitting 80. Further, the loop is provided with a metal thimble 82. The pressed fitting 80 limits the movement of the cables 76 in one direction and a second pressed fitting 84 limits the movement of the cable in the opposite direction.

The equivalent cable 76, of boom section 40, is connected to cable 76 by a double shackle 88. The double shackles 88 receive shackle pins 90 like shackle pins 72 which again receive on the non-headed end carter pins 92. With this form of construction as more clearly shown in FIG. 6, the adjacent pins of each pair of booms is very simply by sturdily connected. The position of the fitted sleeves 80 and 84 the length of the loops 78 in the cables and the size of the double shackles 88 is such that there is always maintained a slack between each boom section as more clearly illustrated in FIG. 6, which slack is formed by flap 54 and furcated flaps 58 and 62, thus all parting stresses are placed on the cables which in turn transmits such thrust to the pair of plates 64 and 66, which are bolted together on opposite sides of the boom. With this form of construction, boom leakage is maintained at a minimum, while at the same time ease of assembly is insured.

It will be particularly noted from FIG. 6 that each side of the boom is provided with the cables 76, eyes 70, connnectors 88, etc. By providing cables on each side of the boom, insures that regardless of the direction of currents, predominate wave action and/or winds, the cables will take the stress and relieve all stresses on the boom fabric. Further, with cables each side of the boom connected to the boom via the plates 66, etc. anchoring and shaping lines or cables such as illustrated at 30, 32, 34, 36, 38, and 40 may be connected to either or both sides of the boom and stresses on the boom due to such anchors or cables will be into the cables 76 rather than the boom fabric.

In order to provide for a stable type connection between the boom sections, the lower edge of each of the skirts 46 is turned up to form a pouch generally designated 98. The pouches 98 receive a ballast chain 100 and the ends or end links 102 of each ballast chain 100 are connected by dual end shackles 104 similar in construction to shackles 88 hereinbefore described. The links 102 of the chains 100 are maintained in the shackles by shackle pins 106 which shackle pins are bored to receive carter pins at their lower ends. With the two-point spaced connectors, even during high seas, no stresses are placed on the overlapped seal provided by flaps 54, 58 and 62 and their sister hooks 60.

Figure 2:
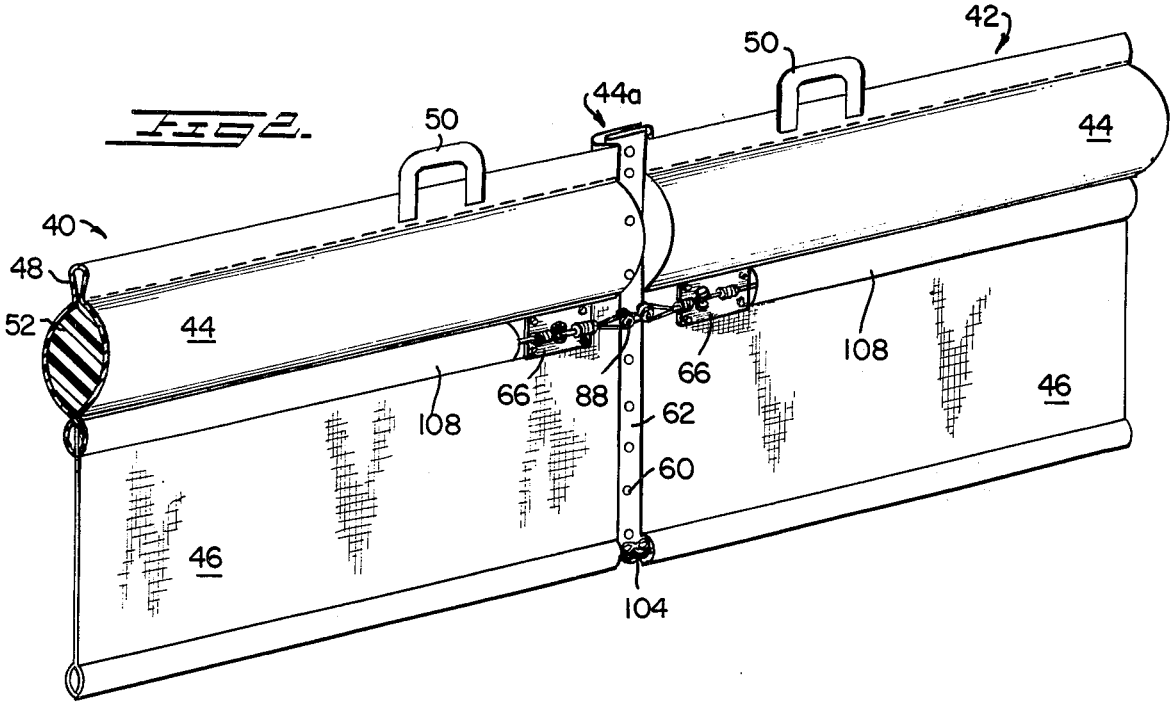
FIG. 2 is a perspective view of a portion of a pair of boom sections of the type wherein each of the floating booms includes a relatively long depending skirt.
Figure 4:
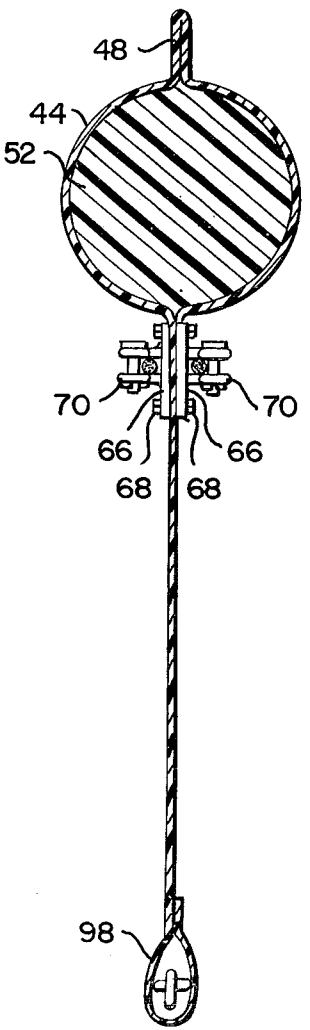
FIG. 4 is a section on line 4—4 of FIG. 3.

Also, as illustrated in FIGS. 2 and 3, at the upper end of each skirt portion 46 and immediately below the tubular portions 44 of each boom 40, 42 are provided longitudinally extending pouches or pockets 108, one on each side. The pouches 108 have a longitudinal length less than the length of the boom so that at each end of each boom section the flexible draft members 76 to be strung therethrough project into the open to provide room for the plates 66 and the associated connectors as more clearly shown in FIGS. 2 and 3.

As hereinbefore described, a plurality of cables or chains, such as, 30, 32, 34, 36, 38 and 40 are employed to maintain the zone to be encircled by the boom sections in the desired configuration. The cables 30, 32, etc. are provided with eyes at their ends, such as eyes 78, FIG. 5 of the drawing and are connected to the shackles or other connectors 88 by a further and similar connector. Thus, not only are the cables connected to the barrier booms, but also the cables are prevented from lateral movement by the connection of eyes 78, at each end of the cable, to the metal plates and such connections are made where substantially no strain is placed on the fabric forming the boom sections.

Any suitable form of cables 76 (FIG. 3) or chains 100 (FIG. 3) can be used in the unit; however, in order to insure the integrity of the boom even in rivers which may contain floating debris such as trees, logs, etc., tensile strengths in the order of from about 4,000 to 80,000 pounds is desirable in the cables and chains.

It has been found that the boom sections 40–42 (FIG. 2), each having a length of about 50 feet and a diameter of about 6–8 inches, provides very satisfactory results. However, the length of each section may be from 2 feet to 100 feet and the diameter of each tubular section may be from 3 inches to as much as 36 inches. When the boom sections each include a depending skirt, such as skirt 46, a skirt length of about 24–30 inches is satisfactory for open water containment and will prevent underflow of oil in low and moderate water currents and skirt lengths of from 6 inches to more than 36 inches have been found to be useful.

Throughout the specification and in the drawings, the invention has been described as being deployed with a substantial freeboard; however, it will be recognized that in some cases the barrier is below the surface of the water with, for example, the lower edge of the skirt on or adjacent to the bottom of the water body. Further, two or more barrier units may be assembled in stacked superimposed relation.

One of the additional advantages of the present form of construction is that, if the skirt and/or tubular sleeve become worn or torn, the hardwear such as the cables 76; the connectors 80, etc., chain 100, etc. and the flotation unit 52 may be reused with a new fabric sleeve and skirt.

The capability of reuse of the hardware materially reduces the expense of maintaining serviceable booms. In fact, it has been found that in some instances it is less expensive to refabric old hardware than it is to clean used boom sections used on dirty oil spills.

Further, it will be appreciated by those skilled in the art that, when the flotation material within the booms comprises absorbent or adsorbent material, it may be readily replaced after the utility of the initial charge has been exhausted.

What has been set forth above is intended as exemplary of the present invention to enable those skilled in the art to practice the invention and what is new and therefore desired to be protected by Letters Patent of the United States is.

I claim:

1. A barrier for containing and controlling water carried pollutants comprising a series of boom sections, each boom section comprising a generally tubular portion and a skirt portion, each of the tubular portions containing a flotation material, and means connecting the boom sections in end to end relationship characterized by generally liquid impervious connectors for the ends of the boom sections; a first vertical flap extending along one edge of one end of the skirt portion and the tubular portion of each boom section; a pair of flaps extending along the other edge of the opposite end of the skirt portion and the tubular portion of each boom section; said pair of flaps arranged to receive said first flap therebetween; separable connectors maintaining the first flap between said pair of flaps; a pair of rigid metallic plates at each end of each boom section; each said pair of plates being secured together on opposite sides of the skirt immediately below the tubular portion; each plate of each pair of plates having secured thereto a pair aligned eyes; a flexible draft member extending along each side of each boom section just below the tubular portion; each flexible draft member having an eye formed at each end; a double ended shackle detachable connecting adjacent eyes of each flexible draft member, and means cooperating with the flexible draft members and the aligned eyes of each plate connecting the flexible draft members to said plates.

2. The invention defined in claim 1 further including a ballist chain along the bottom edge of each skirt of each each boom section and link means connect the ends of the ballist chain of adjacent boom sections.

3. The invention defined in claim 2 wherein the pairs of plates are separately connectable to the boom skirts so that said plates, cables are ballist chains may be simply removed for reuse on a new boom fabric.

* * * * *